United States Patent [19]

Takahashi et al.

[11] Patent Number: 4,699,873

[45] Date of Patent: Oct. 13, 1987

[54] NEGATIVE SILVER HALIDE PHOTOGRAPHIC LIGHT-SENSITIVE MATERIAL

[75] Inventors: Toshiro Takahashi; Shigeo Hirano, both of Kanagawa, Japan

[73] Assignee: Fuji Photo Film Co., Ltd., Kanagawa, Japan

[21] Appl. No.: 823,720

[22] Filed: Jan. 29, 1986

[30] Foreign Application Priority Data

Jan. 29, 1985 [JP] Japan ..... 60-14959

[51] Int. Cl.[4] ..... G03C 1/06

[52] U.S. Cl. ..... 430/446; 430/564; 430/264; 430/265; 430/267; 430/949; 430/600; 430/601; 430/603; 430/614; 430/599; 430/448

[58] Field of Search ..... 430/264, 265, 267, 611, 430/603, 601, 446, 448, 600, 614, 564, 949, 599

[56] References Cited

U.S. PATENT DOCUMENTS

| | | | |
|---|---|---|---|
| 2,419,974 | 5/1947 | Stauffer et al. | 430/599 |
| 2,438,716 | 3/1948 | Mueller | 430/611 |
| 2,440,110 | 4/1948 | Mueller | 430/611 |
| 2,756,145 | 7/1956 | Ballard et al. | 430/611 |
| 3,062,654 | 11/1962 | Allen et al. | 430/611 |
| 3,128,186 | 4/1964 | Corben et al. | 430/611 |
| 3,226,232 | 12/1965 | Dersch et al. | 430/611 |
| 3,926,632 | 12/1975 | Hofman et al. | 430/267 |
| 4,247,620 | 1/1981 | Nagatani et al. | 430/601 |
| 4,272,606 | 6/1981 | Mifune et al. | 430/267 |
| 4,521,508 | 6/1985 | Sugimoto et al. | 430/611 |

*Primary Examiner*—Won H. Louie

*Attorney, Agent, or Firm*—Sughrue, Mion, Zinn, Macpeak and Seas

[57] ABSTRACT

A negative silver halide photographic light-sensitive material comprising a support having provided thereon at least one silver halide emulsion layer is disclosed. At least one of the silver halide emulsion layers or another hydrophilic colloidal layer of the material contains a hydrazine derivative and a compound represented by the formula:

$$R_1—S—S—R_2$$

wherein $R_1$ and $R_2$, which may be the same or different, each represents an aliphatic group, an aromatic group or a heterocyclic group, or when $R_1$ and $R_2$ are both aliphatic groups they may together form a ring. The material can rapidly form a superhigh contrast image using a stable processing solution.

21 Claims, No Drawings

NEGATIVE SILVER HALIDE PHOTOGRAPHIC LIGHT-SENSITIVE MATERIAL

FIELD OF THE INVENTION

This invention relates to a silver halide photographic light-sensitive material and, more particularly, to a silver halide photographic light-sensitive material which can rapidly form a superhigh contrast image useful in a photomechanical process using a stable processing solution.

BACKGROUND OF THE INVENTION

In the photomechanical process, it is necessary to obtain a photographic characteristic of superhigh contrast (particularly, having a gamma of 10 or more) in order to achieve satisfactory reproduction of a continuous gradation by dot images or reproduction of a line image. Superhigh contrast has generally been obtained by using a combination of a light-sensitive material comprising a silver chloride emulsion or a silver chlorobromide emulsion having a high silver chloride content and a hydroquinone developer having an extremely low effective concentration, usually not more than 0.1 mol/l, of a sulfite ion (infectious developer). However, such an infectious developer is seriously labile due to its low sulfite ion concentration and cannot withstand preservation for more than 3 days.

An improved process for obtaining a superhigh contrast characteristic with a stable developer has been proposed in U.S. Pat. No. 4,224,401, etc., in which a specific hydrazine compound is used. According to this process, presence of a high concentration sulfite ion in a developer is permissible so that stability of the developer against air oxidation can be improved.

It has also been proposed in Japanese Patent Application (OPI) No. 106244/81 (the term "OPI" as used herein refers to a "published unexamined Japanese patent application") (which corresponds to U.S. Pat. No. 4,269,929) that an amine compound is added to the above-described developer containing a hydrazine compound in order to obtain a negative image having a high gamma value with a developer at a lower pH value, for example, at 10.8 to 11.4.

However, the above-described image formation process still involves a problem in that a superhigh contrast image is hardly obtained in the so-called rapid access processing which has recently enjoyed an increasing demand, i.e., an extremely rapid photographic processing generally requiring only from 90 to 120 seconds for total processing of from the start of development through drying to obtain a processed film with development processing completing within 15 to 60 seconds.

SUMMARY OF THE INVENTION

Accordingly, one object of this invention is to provide a negative silver halide photographic light-sensitive material which can provide a superhigh contrast image having a gamma exceeding 10 with a stable developer.

Another object of this invention is to provide a superhigh contrast image having a gamma exceeding 10.

These objects can be accomplished by a negative silver halide light-sensitive photograhic material comprising a support having provided thereon at least one silver halide emulsion, in which one of the silver halide emulsion layer or another hydrophilic colloidal layer contains a hydrazine derivative and a compound represented by the formula (A):

$$R_1—S—S—R_2 \qquad (A)$$

wherein $R_1$ and $R_2$, which may be the same or different, each represents a substituted or unsubstituted aliphatic group, a substituted or unsubtituted aromatic group or a substituted or unsubstituted heterocyclic group, or when $R_1$ and $R_2$ are both aliphatic groups they may together form a ring.

DETAILED DESCRIPTION OF THE INVENTION

In the above-described formula (A), the aliphatic group represented by $R_1$ or $R_2$ preferably includes a straight or branched chain alkyl, alkenyl, alkynyl or cycloalkyl group.

The alkyl group contains from 1 to 18 carbon atoms and includes, for example, a methyl group, an ethyl group, a propyl group, a butyl group, a hexyl group, a decyl group, a dodecyl group, an isopropyl group, a t-butyl group, a 2-ethylhexyl group, etc.

The alkenyl group contains from 2 to 20 carbon atoms and includes, for example, an allyl group, a 2-butenyl group, a 7-octenyl group, etc.

The alkynyl group contains from 2 to 20 carbon atoms and includes, for example, a 2-propynyl group, a 2-butynyl group, etc.

The cycloalkyl group contains from 3 to 12 carbon atoms and includes, for example, a cyclopropyl group, a cyclopentyl group, a cyclohexyl group, a cyclododecyl group, etc.

The aromatic group represented by $R_1$ or $R_2$ contains from 6 to 20 carbon atoms and includes, for example, a phenyl group, a naphthyl group, etc.

The heterocyclic group represented by $R_1$ or $R_2$ is a 3- to 7-membered ring containing at least one of a nitrogen atom, an oxygen atom and a sulfur atom, and such a ring may be condensed with a benzene ring.

Specific examples of the heterocyclic ring are pyrrolidine, piperidine, tetrahydrofuran, tetrahydropyran, oxirane, pyrrole, pyridine, furan, thiophene, imidazoline, pyrazolidine, imidazole, pyrasole, pyrazine, pyrimidine, morpholine, oxazole, thiazole, triazole, tetrazole, thiadiazole, oxadiazole, and the above rings condensed with a benzene ring.

The ring jointly formed by $R_1$ and $R_2$ is a 4- to 7-membered ring and includes, for example,

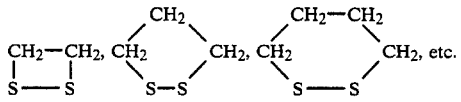

Substituents for the above groups represented by $R_1$ to $R_2$ include an alkyl group having from 1 to 12 carbon atoms, e.g., a methyl group, an ethyl group, a butyl group, a decyl group, etc.; an alkenyl group having from 2 to 12 carbon atoms, e.g., an allyl group, a 2-butenyl group, etc.; an alkynyl group having from 2 to 12 carbon atoms, e.g., a propargyl group, a 2-butynyl group, etc.; a cycloalkyl group having from 3 to 12 carbon atoms, e.g., a cyclopropyl group, a cyclohexyl group, etc.; an aryl group having from 6 to 10 carbon atoms, e.g., a phenyl group, etc.; a halogen atom, e.g., a fluorine atom, a chlorine atom, a bromine atom and an iodine atom; an alkoxy group having from 1 to 10 carbon atoms, e.g., a methoxy group, an ethoxy group, a hexyloxy group, etc.; an aryloxy group having from 6 to 10 carbon atoms, e.g., a phenoxy group, etc.; a carboxyl group; an alkoxycarbonyl group having from 2 to 20 carbon atoms, e.g., a methoxycarbonyl group, an ethoxycarbonyl group, etc.; an aryloxycarbonyl group having from 7 to 11 carbon atoms, e.g., a phenoxycarbonyl group, etc.; an amino group; an acyl group having from 1 to 20 carbon atoms, e.g., an acetyl group, etc.; a carbamoyl group; a hydroxyl group; an acyloxy group having from 2 to 20 carbon atoms, e.g., an acetoxy group, etc.; an aryloyloxy group having from 7 to 11 carbon atoms, e.g., a benzoyloxy group, etc.; an amido group having from 1 to 20 carbon atoms, e.g., an acetamido group, a hexanamido group, a benzamido group, etc.; a sulfo group; a sulfonyl group having from 1 to 12 carbon atoms, e.g., a methanesulfonyl group, a benzenesulfonyl group, etc.; an alkylthio group having from 1 to 20 carbon atoms, e.g., a methylthio group, an ethylthio group, a hexadecylthio group, etc.; an arylthio group having from 6 to 10 carbon atoms, e.g., a phenylthio group, etc.; a sulfamoyl group; an alkyldisulfido group having from 1 to 20 carbon atoms, e.g., a methyldisulfido group, etc.; a sulfonamido group having from 1 to 20 carbon atoms, e.g., a methanesulfonamido group, a benzenesulfonamido group, etc.; a ureido group having from 1 to 20 carbon atoms, e.g., a methylureido group, a phenylureido group, etc.; a thioureido group having from 1 to 20 carbon atoms, e.g., a methylthioureido group, a phenylthioureido group, etc.; a thioamido group having from 1 to 20 carbon atoms, e.g., a thioacetamido group, a thiobenzamido group, etc.; a cyano group; and a nitro group. $R_1$ or $R_2$ may have one or more of these substituents. Further, each substituent may be substituted with the above-enumerated substituent.

$R_1$ and $R_2$ each preferably represents an aliphatic group, and more preferably they jointly represent a ring.

Preferred substituents for the above-enumerated substituents are

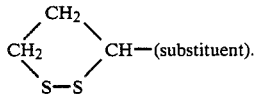

Specific examples of the compounds represented by the formula (A) are shown below, but these examples are not deemed to limit the present invention.

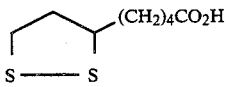

A-1

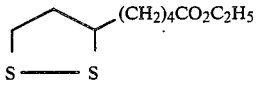

A-2

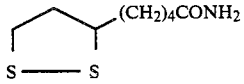

A-3

-continued

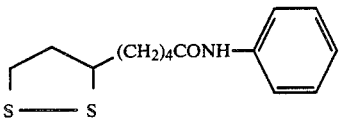

A-4

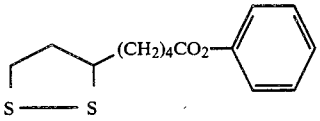

A-5

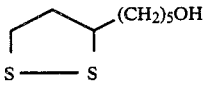

A-6

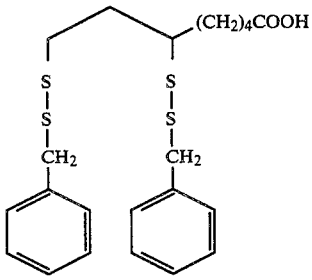

A-7

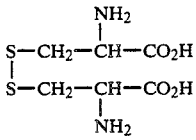

A-8

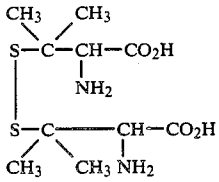

A-9

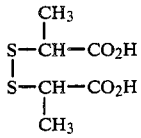

A-10

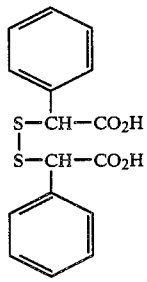

A-11

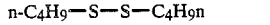

A-12

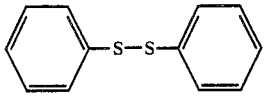

A-13

-continued

A-14

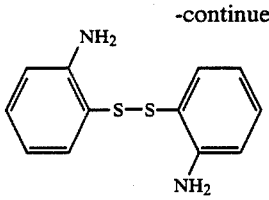

A-15

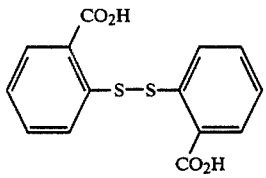

A-16

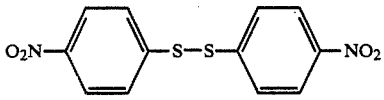

A-17

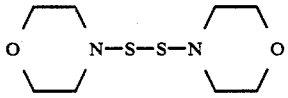

A-18

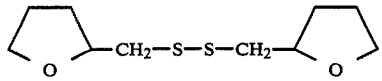

The compound represented by the formula (A) is preferably used in an amount of from $1\times10^{-7}$ to $1\times10^{-2}$ mol, and more preferably from $1\times10^{-6}$ to $5\times10^{-3}$ mol, per mol of silver halide.

The compound of the formula (A) can be incorporated into a photographic light-sensitive material by dissolving it in water in the situation where it is water-soluble, or dissolving it in a water-miscible organic solvent, such as an alcohol (e.g., methanol, ethanol), an ester (e.g., ethyl acetate), a ketone (e.g., acetone), etc., in situations where it is water-insoluble, and then adding the solution to a silver halide emulsion or a hydrophilic colloidal dispersion.

The hydrazine derivative which can be used in the present invention preferably includes arylhydrazides in which a sulfinic acid residue is bonded to the hydrazo moiety thereof in a conventional manner as disclosed in U.S. Pat. No. 4,478,928 and, in addition, compounds represented by the formula (I):

$$R_3\text{—NHNH—G—}R_4 \qquad \text{(I)}$$

wherein $R_3$ represents an aliphatic or aromatic group; $R_4$ represents a hydrogen atom, a substituted or unsubstituted alkyl group, a substituted or unsubstituted aryl group, a substituted or unsubstituted alkoxy group or a substituted or unsubstituted aryloxy group; and G represents a carbonyl group, a sulfonyl group, a sulfoxy group, a phosphoryl group, or an N-substituted or unsubstituted iminomethylene group.

In the above-described formula (I), the aliphatic group as represented by $R_3$ contains from 1 to 30 carbon atoms and preferably includes a straight chain, branched chain or cyclic alkyl group having from 1 to 20 carbon atoms. The branched chain alkyl group may be cyclized so as to form a saturated heterocyclic ring containing at least one hetero atom. The alkyl group may be substituted with an aryl group, an alkoxy group, a sulfoxy group, a sulfonamido group, a carbonamido group, etc.

The aromatic group as represented by $R_3$ is a monocyclic or bicyclic aryl group or an unsaturated heterocyclic group. The unsaturated heterocyclic group may be condensed with a mono- or bicyclic aryl group to form a heteroaryl group.

Examples of the aromatic group for $R_3$ include a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, etc., with those groups containing a benzene ring being preferred.

A particularly preferred group for $R_3$ is an aryl group.

The aryl group or unsaturated heterocyclic group may be substituted. Typical examples of the substituents are a straight, branched chain or cyclic alkyl group, preferably containing from 1 to 20 carbon atoms; an aralkyl group, preferably a mono- or bicyclic aralkyl group containing from 1 to 3 carbon atoms in its alkyl moiety; an alkoxy group, preferably containing from 1 to 20 carbon atoms; a substituted amino group, preferably substituted with an alkyl group having from 1 to 20 carbon atoms; an acylamino group, preferably having from 2 to 30 carbon atoms; a sulfonamido group, preferably having from 1 to 30 carbon atoms; a ureido group, preferably containing from 1 to 30 carbon atoms; and the like.

The alkyl group as represented by $R_4$ preferably contains from 1 to 4 carbon atoms and may be substituted with a halogen atom, a cyano group, a carboxyl group, a sulfo group, an alkoxy group, a phenyl group, or the like.

The substituted or unsubstituted aryl group as represented by $R_4$ is a monocyclic or bicyclic aryl group, e.g., a benzene ring-containing group. The aryl group may be substituted with, for example, a halogen atom, an alkyl group, a cyano group, a carboxyl group, a sulfo group, etc.

The substituted or unsubstituted alkoxy group as represented by $R_4$ contains from 1 to 8 carbon atoms. The substituent includes, for example, a halogen atom, an aryl group, etc.

The substituted or unsubstituted aryloxy group as represented by $R_4$ is preferably monocyclic. The substituent therefor includes a halogen atom, etc.

Preferred groups for $R_4$ are a hydrogen atom, a methyl group, a methoxy group, an ethoxy group and a substituted or unsubstituted phenyl group, with a hydrogen atom being particularly preferred, when G represents a carbonyl group; a methyl group, an ethyl group, a phenyl group and a 4-methylphenyl group, with a methyl group being more preferred, when G represents a sulfonyl group; a methoxy group, an ethoxy group, a butoxy group, a phenoxy group and a phenyl group, with a phenoxy group being more preferred, when G is a phosphoryl group; a cyanobenzyl group and a methylthiobenzyl group when G is a sulfoxy group; or a methyl group, an ethyl group and a substituted or unsubstituted phenyl group when G represents an N-substituted or unsubstituted iminomethylene group.

$R_3$ or $R_4$ may carry a ballast group that is commonly employed in immobile photographic additives, e.g., couplers. The ballast group contains 8 or more carbon atoms and is relatively inert to photographic characteristics. Examples of such a ballast group include an alkyl group, an alkoxy group, a phenyl group, an alkylphenyl group, a phenoxy group, an alkylphenoxy group, etc.

$R_3$ or $R_4$ may further carry a group that enhances adsorption onto silver halide grain surfaces. Such an adsorbing group includes those described in U.S. Pat. No. 4,385,108, such as a thiourea group, a heterocyclic thioamido group, a mercapto heterocyclic group, a triazole group, etc.

The most preferred group for G in the formula (I) is a carbonyl group.

Specific examples of the compounds represented by the formula (I) are shown below, but it should be noted that the present invention is not limited thereto.

I-1

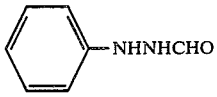

I-2

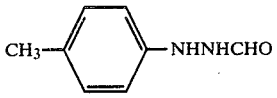

I-3

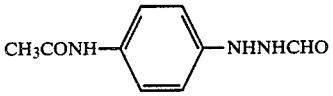

I-4

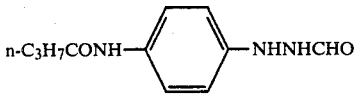

I-5

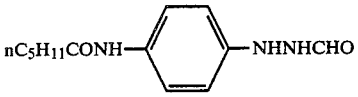

I-6

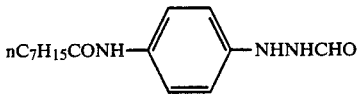

I-7

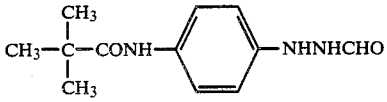

I-8

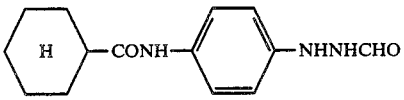

I-9

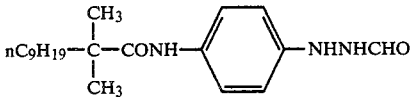

I-10

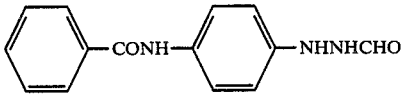

I-11

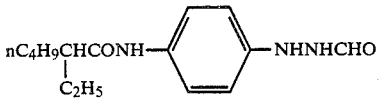

I-12

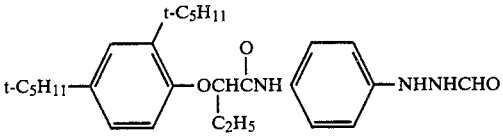

I-13

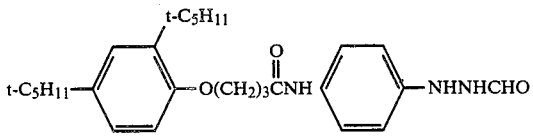

I-14

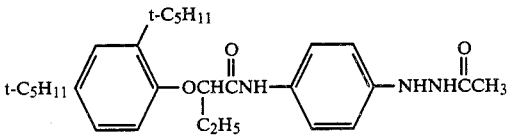

I-15

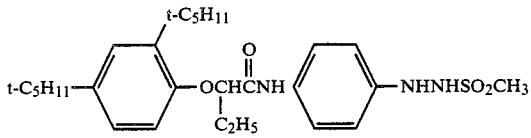

I-16

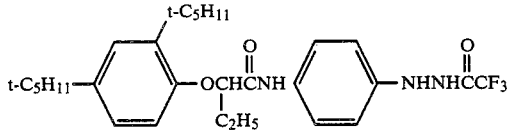

I-17

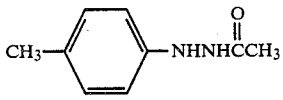

I-18

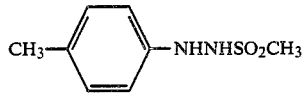

I-19

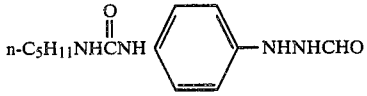

I-20

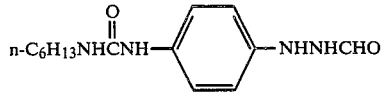

I-21

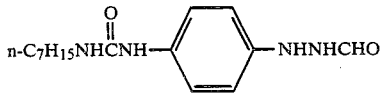

-continued

I-22

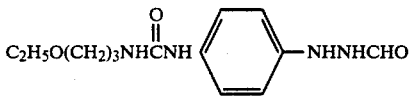

I-23

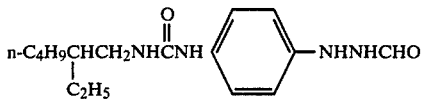

I-24

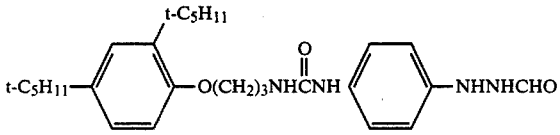

I-25

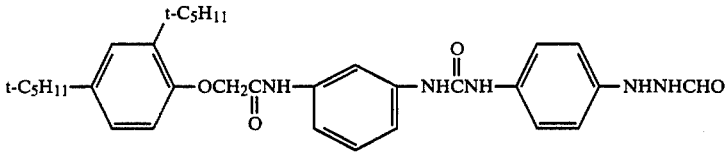

I-26

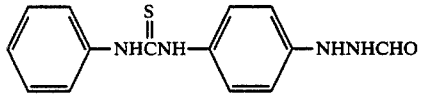

I-27

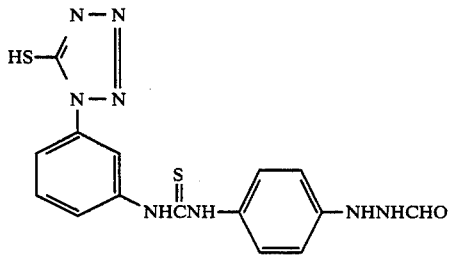

I-28

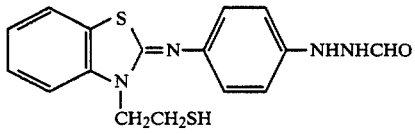

I-29

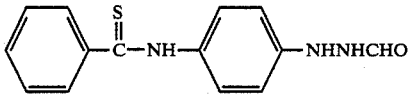

I-30

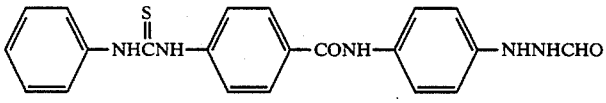

I-31

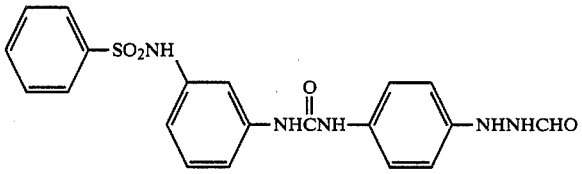

The hydrazine derivative according to the present invention can be used in an amount of from $1\times10^{-6}$ to $5\times10^{-2}$ mol, and preferably from $1\times10^{-5}$ to $2\times10^{-2}$ mol, per mol of silver halide.

The hydrazine derivative according to the present invention can be incorporated into a photographic light-sensitive material by dissolving it in water where it is water-soluble or in a water-miscible organic solvent, such as an alcohol (e.g., methanol, ethanol), an ester (e.g., ethyl acetate), a ketone (e.g., acetone), etc., in cases where it is water-insoluble, and then adding the solution to a silver halide emulsion or a hydrophilic colloidal solution.

The compound of the formula (A) and the hydrazine derivative according to the present invention can be added to the same layer including one or more emulsion layers or other hydrophilic colloidal layer, or may be separately added to different layers. Further, they may be added to both an emulsion layer and another hydrophilic colloidal layer.

In order to ensure the effect of the present invention, a compound represented by the following formula (II) can also be used in combination with the above-described compound (A) and the hydrazine derivative:

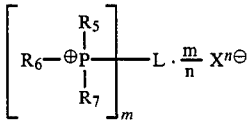

(II)

wherein $R_5$, $R_6$ and $R_7$ each represents a substituted or unsubstituted alkyl group, a substituted or unsubstituted cycloalkyl group, a substituted or unsubstituted aryl group, a substituted or unsubstituted alkenyl group, a substituted or unsubstituted cycloalkenyl group or a substituted or unsubstituted heterocyclic group; m represents an integer; L represents an m-valent organic group which is bonded to the P atom via a carbon atom of L; n represents an integer of from 1 to 3; and X represents an n-valent anion which may be connected to L.

Examples of the groups as represented by $R_5$, $R_6$ and $R_7$ include a straight or branched chain alkyl group, e.g., a methyl group, an ethyl group, a propyl group, an isopropyl group, a butyl group, an isobutyl group, a sec-butyl group, a t-butyl group, an octyl group, a 2-ethylhexyl group, a dodecyl group, a hexadecyl group, an octadecyl group, etc.; a cycloalkyl group, e.g., a cyclopropyl group, a cyclopentyl group, a cyclohexyl group, etc.; an aryl group, e.g., a phenyl group, a naphthyl group, a phenanthryl group, etc.; an alkenyl group, e.g., an allyl group, a vinyl group, a 5-hexenyl group, etc.; a cycloalkenyl group, e.g., a cyclopentenyl group, a cyclohexenyl group, etc.; and a heterocyclic group, e.g., a pyridyl group, a quinolyl group, a furyl group, an imidazolyl group, a thiazolyl group, a thiadiazolyl group, a benzotriazolyl group, a benzothiazolyl group, a morpholyl group, a pyrimidyl group, a pyrrolidyl group, etc. Substituents for these groups include those enumerated for $R_5$, $R_6$ and $R_7$ and, in addition, a halogen atom (e.g., a fluorine atom, a chlorine atom, a bromine atom, an iodine atom), a nitro group, a primary, secondary or tertiary amino group, an alkyl or aryl ether group, a carbonamido group, a carbamoyl group, a sulfonamido group, a sulfamoyl group, a hydroxyl group, a sulfoxy group, a sulfonyl group, a carboxyl group, a sulfo group, a cyano group and a carbonyl group. Examples of the group represented by L include those enumerated for $R_5$, $R_6$ and $R_7$ and, in addition, a polymethylene group, e.g., a trimethylene group, a tetramethylene group, a hexamethylene group, a pentamethylene group, an octamethylene group, a dodecamethylene group, etc.; a divalent aromatic group, e.g., a phenylene group, a biphenylene group, a naphthylene group, etc.; a polyvalent aliphatic group, e.g., a trimethylenemethyl group, a tetramethylenemethyl group, etc.; a polyvalent aromatic group, e.g., a phenylene-1,3,5-toluyl group, a phenylene-1,2,4,5-tetrayl group, etc.; and the like.

Examples of the anion represented by X include a halogen ion, e.g., a chlorine ion, a bromine ion, an iodine ion, etc.; a carboxylate ion, e.g., an acetate ion, an oxalate ion, a fumarate ion, a benzoate ion, etc.; a sulfonate ion, e.g., a p-toluenesulfonate ion, a methanesulfonate ion, a butanesulfonate ion, a benzenesulfonate ion, etc.; a sulfate ion, a perchlorate ion, a carbonate ion and a nitrate ion.

Particularly preferred among the compounds represented by the formula (II) are those wherein m represents an integer of 1 or 2; L represents a group having not more than 20 carbon atoms selected from the groups recited for $R_5$, $R_6$ and $R_7$ or a divalent organic group having not more than 20 carbon atoms which is bonded to the P atom via a carbon atom of L; n represents an integer of 1 or 2; and X represents a monovalent or divalent anion which may be connected to L.

Many of the compounds represented by the formula (II) are known per se and are commercially available as reagents. General processes for synthesizing these compounds include a process of reacting phosphinic acids with an alkylating agent, such as alkyl halides and sulfonic esters, for example, alkyl iodide, alkyl bromide, etc., and p-toluenesulfonate, and a process of exchanging a counter anion of phosphonium salts in a usual manner.

Specific examples of the compounds of the formula (II) are shown below, but it should be understood that these examples are not limiting the present invention.

II-1

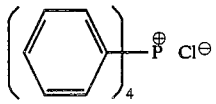

II-2

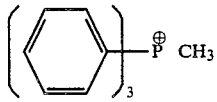

II-3

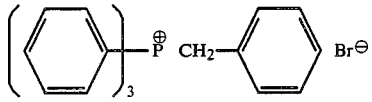

II-4

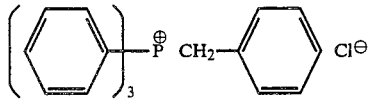

II-5

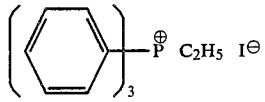

II-6

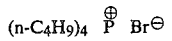

II-7

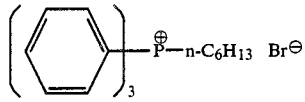

II-8

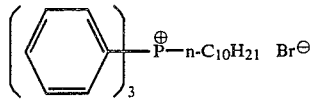

II-9

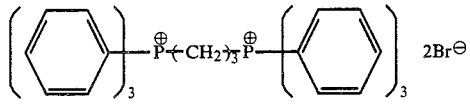

II-10

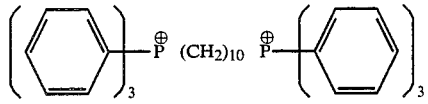

II-11

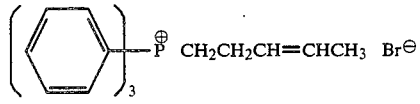

II-12

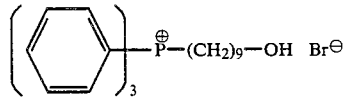

-continued

II-13

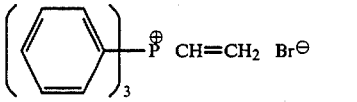

II-14

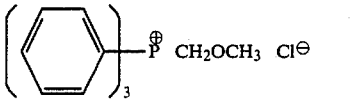

II-15

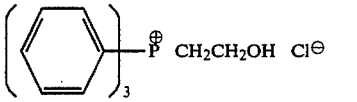

II-16

$Ph_3\overset{\oplus}{P}-(CH_2)_4COOH\ Br^{\ominus}$

II-17

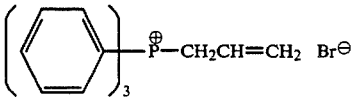

II-18

$(n\text{-}C_4H_9)_3\overset{\oplus}{P}-n\text{-}C_{16}H_{33}\ Br^{\ominus}$

II-19

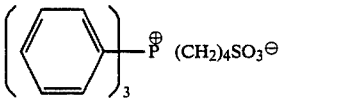

II-20

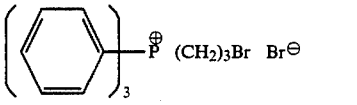

II-21

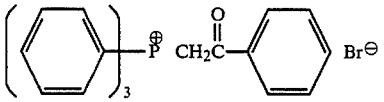

II-22

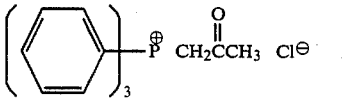

II-23

$(n\text{-}C_4H_9)_3\overset{\oplus}{P}\ CH_2CH_2OH\ Br^{\ominus}$

II-24

$(n\text{-}C_4H_9)_3\overset{\oplus}{P}\ C_2H_5\cdot\tfrac{1}{2}\cdot SO^{2\ominus}$

II-25

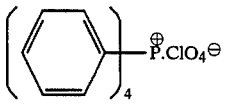

II-26

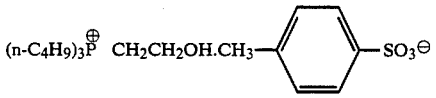

II-27

$(n\text{-}C_4H_9)_3\overset{\oplus}{P}\ CH_3\ I^{\ominus}$

II-28

$(HOCH_2)_3\overset{\oplus}{P}\ CH_3\ I^{\ominus}$

II-29

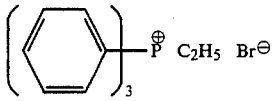

-continued

II-30

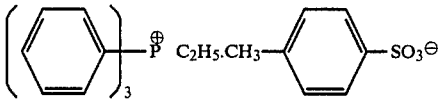

The compound represented by the formula (II) may be added to a developer but is preferably added to at least one of silver halide emulsion layers or other hydrophilic colloidal layers. The preferred amount to be added is from $10^{-5}$ to $10^{-2}$ mol per liter of a developer in the former case, and from $1\times10^{-6}$ to $1\times10^{-1}$ mol, and more preferably from $1\times10^{-5}$ to $5\times10^{-2}$ mol, per mol of silver halide in the latter case.

The compound of the formula (II) can be incorporated into a photographic light-sensitive material by dissolving it in water in cases where it is water-soluble, or in a water-miscible organic solvent, such as an alcohol (e.g., methanol, ethanol), an ester (e.g., ethyl acetate), a ketone (e.g., acetone), etc., in cases where it is water-insoluble, and adding the solution to a silver halide emulsion or a hydrophilic colloidal solution.

The compound of the formula (II) can be added to the same layer including one or more emulsion layers or other hydrophilic colloidal layer, or may be separately added to different layers. Further, they may be added to both an emulsion layer and another hydrophilic colloidal layer.

The silver halides to be used in the light-sensitive silver halide emulsion layers are not particularly limited and include silver chloride, silver chlorobromide, silver chloiododobromide, silver iodobromide, silver bromide, etc. In the case of using silver iodobromide or silver chloroiodobromide, a silver iodide content is preferably not more than 5 mol%.

There is no particular limitation in the form, crystal habit and size distribution of silver halide grains to be used, but it is preferable to use grains having a grain size of not greater than 0.7 μm.

Sensitivity of the silver halide emulsion can be increased without making grains corase by chemical sensitization with a gold compound, e.g., chloroaurates, gold (III) chloride, etc., or a salt of a noble metal, e.g., rhodium, iridium, etc.; a sulfur compound capable of forming silver sulfide upon reacting with a silver salt; or a reducing material, e.g., stannous salts, amines, etc.

Further, a salt of a noble metal, e.g., rhodium, iridium, etc., or an iron compound, e.g., potassium ferricyanide, may be present during physical ripening or nucleation of silver halide grains.

Hydrophilic colloids or binders which can be advantageously used in light-insensitive upper layers, emulsion layers and other layers in the present invention include gelatin. Other hydrophilic colloids may also be employed.

Examples of the hydrophilic colloids other than gelatin which may be used include proteins, e.g., gelatin derivatives, graft polymers of gelatin and other high polymers; cellulose derivatives, e.g., hydroxyethyl cellulose, carboxymethyl cellulose, cellulose sulfate, etc.; sugar derivatives, e.g., sodium alginate, starch derivatives, etc.; and a wide variety of synthetic hydrophilic high polymeric materials, such as polyvinyl alcohol partial acetal, poly-N-vinylpyrrolidone, polyacrylic acid, polymethacrylic acid, polyacrylamide, polyvinylimidazole, polyvinylpyrazole, etc., and copolymers comprising monomers constituting the above-described homopolymers.

The gelatin to be used includes not only lime-processed gelatin but also acid-processed gelatin and enzyme-processed gelatin as described in *Bull. Soc. Sci. Phot. Japan,* 16, 30 (1966). In addition, hydrolysis products and enzymatic decomposition products of gelatin may also be employed.

Photographic emulsions which can be used in the present invention may be spectrally sensitized with methine dyes or other dyes. Dyes to be used for spectral sensitization include cyanine dyes, merocyanine dyes, complex cyanine dyes, complex merocyanine dyes, holopolar cyanine dyes, hemicyanine dyes, styryl dyes and hemioxonol dyes, with cyanine dyes, merocyanine dyes and complex merocyanine dyes being particularly useful.

These sensitizing dyes may be used individually or in combinations thereof. A combination of the sensitizing dyes is frequently used for the purpose of supersensitization. Moreover, the emulsion may further contain a substance which does not have a spectral sensitizing activity per se or does not substantially absorb visible light but exhibits a supersensitizing activity when used in combination with the sensitizing dyes.

Binders or protective colloids which can be advantageously used in emulsion layers or intermediate layers of the light-sensitive materials according to the present invention include gelatin. Other hydrophilic colloids may also be used.

Examples of the useful hydrophilic colloids other than gelatin include proteins, e.g., gelatin derivatives, graft polymers of gelatin with other high polymers, albumin, casein, etc.; cellulose derivatives, e.g., hydroxyethyl cellulose, carboxymethyl cellulose, cellulose sulfate, etc.; sugar derivatives, e.g., sodium alginate, starch derivatives, etc.; and a wide variety of synthetic hydrophilic high polymeric materials, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., and copolymers comprising monomers constituting these homopolymers.

The gelatin to be used include lime-processed gelatin, acid-processed gelatin and enzyme-processed gelatin as described in *Bull. Soc. Sci. Phot. Japan,* 16, 30 (1966). In addition, hydrolysis products or enzymatic decomposition products of gelatin may also be employed.

The photographic emulsions used in the present invention can contain various compounds for the purpose of preventing fog during the preparation, preservation or processing of the light-sensitive materials or for stabilizing photographic properties. Such compounds include azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole), etc.; mercaptopyrimidines; mercaptotriazines; thioketo compounds, e.g., oxazolinethione, etc.; azaindenes, e.g., triazaindenes, tetraazaindenes (particularly, 4-hydroxy-substituted-(1,3,3a,7)-tetraazaindenes), pentaazaindenes, etc.; benzenethiosulfonic acid; benzenesulfinic acid; benzenesulfonic acid amide; and many other compounds known as antifoggants or stabilizers.

Of the above, particularly preferred are benzotriazoles (e.g., 5-methylbenzotriazole) and nitroindazoles (e.g., 5-nitroindazole). These compounds may be incorporated into a processing solution.

The photographic emulsion layers and other hydrophilic colloidal layers of the photographic light-sensitive materials of this invention may contain an organic or inorganic hardener, such as chromium salts (e.g., chromium alum, chromium acetate, etc.), aldehydes (e.g., formaldehydes, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), either alone or in combination thereof.

The photographic emulsion layers or other hydrophilic colloidal layers of the light-sensitive materials of this invention may further contain a wide variety of surface active agents for various purposes, for example, as a coating aid or an antistatic agent, for improvement of slipperiness, as an aid for emulsion dispersion, for prevention of adhesion, for improvement of photographic properties (e.g., development acceleration, increase of contrast and sensitivity), and the like.

Examples of surface active agents which can be used include nonionic surface active agents, such as saponin (steroid type), alkylene oxide derivatives (e.g., polyethylene glycol, polyethylene glycol/polypropylene glycol condensates, polyethylene glycol alkyl ethers or alkylaryl ethers, polyethylene glycol esters, polyethylene glycol sorbitan esters, polyalkylene glycol alkylamines or amides, polyethylene oxide adducts of silicon, etc.), glycidol derivatives (e.g., alkenylsuccinic polyglycerides, alkylphenol polyglycerides, etc.), fatty acid esters of polyhydric alcohols, alkyl esters of sugars, and the like; anionic surface active agents containing an acidic group (e.g., a carboxyl group, a sulfo group, a phospho group, a sulfuric ester group, a phosphoric ester group, etc.), such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, and the like; amphoteric surface active agents, such as amino acids, aminoalkylsulfonic acids, aminoalkyl sulfates or phosphates, alkylbetaines, amine oxides, and the like; and cationic surface active agents, such as alkylamine salts, aliphatic or aromatic quaternary ammonium salts, heterocyclic quaternary ammonium salts (e.g., pyridinium, imidazolium, etc.), aliphatic or heterocyclic phosphonium or sulfonium salts, and the like.

When polyalkylene oxides are used in the present invention, those having a molecular weight of more than 600 as described in Japanese Patent Publication No. 9412/83 (U.S. Pat. No. 4,221,857) are preferred.

The photographic emulsion layers and other hydrophilic colloidal layers of the photographic light-sensitive materials can furthermore contain a dispersion of a water-insoluble or sparingly water-soluble synthetic polymer for the purpose of improving dimensional stability and the like. Examples of such a polymer include polymers comprising either one or a combination of alkyl acrylates or methacrylates, alkoxyalkyl acrylates or methacrylates, glycidyl acrylates or methacrylates, acrylamides or methacrylamides, vinyl esters (e.g., vinyl acetate), acrylonitrile, olefins, styrene, etc.; or a combination of these monomers and acrylic acid, methacrylic acid, $\alpha$, $\beta$-unsaturated dicarboxylic acids, hydroxyalkyl acrylates or methacrylates, sulfoalkyl acrylates or methacrylates, styrenesulfonic acid, etc.

Development of the above-described silver halide light-sensitive materials according to the present invention can be carried out with a stable developer to obtain images of superhigh contrast, and use of the conventional injectious developer or a highly alkaline (near to pH 13) developer as described in U.S. Pat. No. 2,419,975 is not necessary.

In other words, the silver halide light-sensitive materials of this invention can be developed with a developer containing, as a preservative, a sulfite ion at a sufficient concentration, e.g., 0.15 mol or more per liter, and having a pH value of 9.5 or more and, preferably, from 10.5 to 12.3, to thereby obtain a negative image having sufficiently superhigh contrast.

Further, the above-described silver halide light-sensitive materials of this invention are very favorable to rapid access processing, in which development completes within 15 to 60 seconds, with the use of the aforesaid stable developer to provide a negative superhigh contrast gradation having a gamma exceeding 10.

Developing agents which can be used in the present invention are not particularly restricted. For example, dihydroxybenzenes (e.g., hydroquinone), 3-pyrazolidones (e.g., 1-phenyl-3-pyrazolidone, 4,4-dimethyl-1-phenyl-3-pyrazolidone), aminophenols (e.g., N-methyl-p-aminophenol), etc., may be employed either alone or in combinations thereof.

The developer may further contain a pH buffer, such as sulfites, carbonates, borates and phosphates of alkali metals, and a development restrainer or antifoggant, such as bromides, iodides and organic antifoggants (particularly, nitroindazoles or benzotriazoles), and the like. If desired, the developer may also contain a water softener, a dissolving aid, a toning agent, a development accelerator, a surface active agent (preferably, the aforesaid polyalkylene oxides), a defoaming agent, a hardener, a silver stain inhibitor (e.g., 2-mercaptobenzimidazolesulfonic acids), and the like.

Specific examples of these additives are described, e.g., in *Research Disclosure,* No. 176 (17643), December, 1978.

The processing temperature is usually selected between 18° C. and 50° C., but temperatures lower or higher than the above range may also be employed.

A fixer which can be used in the present invention may have the composition generally employed. Fixing agents to be used include not only thiosulfates and thiocyanates, but also organic sulfur compounds known to have a fixing effect. Further, the fixer may contain a water-soluble aluminum salt, etc., as a hardener.

It is desirable to carry out the photographic processing by the use of an automatic developing machine.

The present invention will now be illustrated in greater detail with reference to the following examples, but it should be understood that these examples are not limiting the present invention.

EXAMPLE 1

Monodispersed Negative Silver Halide Emulsions A and B having halogen compositions as shown in Table 1 were prepared according to a controlled double jet process. The mean grain size of Emulsions A and B was adjusted to 0.25 $\mu$m by altering the temperature of charging raw materials. After washing these emulsions with water to remove soluble salts in a known manner, 4-hydroxy-6-methyl-1,3,3a,7-tetraazaindene was added thereto as a stabilizer.

Emulsions A and B each were divided into four portions to make eight samples in all (Sample Nos. 1 to 4 from Emulsion A, Sample Nos. 5 to 8 from Emulsion B). To each of Sample Nos. 1 to 8 was added $2.5\times10^{-3}$ mol of Hydrazine Derivative I-12 according to the present invention per mol of silver, and to each of Sample Nos. 2 to 4 and 6 to 8 was added $1.5\times10^{-3}$ mol of the compound of the formula (A) as shown in Table 1 per mol of silver. 5-Methylbenzotriazole, a dispersion of polyethyl acrylate and sodium 2-hydroxy-4,6-dichloro-1,3,5-triazine were then added to each of these samples, and the resulting compositions was coated to a polyethylene terephthalate film to a silver coverage of 4 g/m$^2$.

The resulting film was exposed to light through a wedge for sensitometry using a 150 line magenta contact screen and subjected to development at 38° C. for 20 seconds with a developer having the following formulation, stopping, fixing, washing and drying.

| Formulation of Developer: | |
|---|---|
| Sodium Ethylenediaminetetraacetate | 1.0 g |
| Sodium Hydroxide | 13.0 g |
| Potassium Tertiary Phosphate | 74.0 g |
| Potassium Sulfite | 90.0 g |
| 3-Diethylamino-1-propanol | 15.0 g |
| N—Methyl-p-aminophenol Hemisulfate | 0.8 g |
| Hydroquinone | 35.0 g |
| 5-Methylbenzotriazole | 0.5 g |
| Sodium Bromide | 3.0 g |
| Water to make | 1 liter (pH 11.6) |

The thus developed film was evaluated for photographic properties, and the results obtained are shown in Table 1 below.

In Table 1, "relative sensitivity" is a reciprocal of an exposure which provides a density of fog+1.5 and is relatively expressed taking that of Sample 1 of Emulsion A or Sample 5 of Emulsion B as 100 (standard).

"Gamma" was obtained by the formula (3.0−0.3/[log E (exposure to provide density of 3.0)−log E (exposure to provide density of 0.3)]

"Dot quality" was visually evaluated in accordance with 5 grades. Grade 5 indicates the best quality, and Grade 1 indicates the worst quality. When applied to halftone plates, dots of Grade 5 or 4 are practically useful; dots of Grade 3 are of poor quality but useful as the lowest limit; and dots of Grade 2 or 1 are too poor in quality to be practically used.

TABLE 1

| Sample No. | Emulsion Type | Emulsion Halogen Composition | Hydrazine Derivative Type | Hydrazine Derivative Amount (mol/mol Ag) | Compound (A) Type | Compound (A) Amount (mol/mol Ag) | Relative Sensitivity | Gamma | Dot Quality |
|---|---|---|---|---|---|---|---|---|---|
| 1 | A | AgBrCl (Br = 70 mol %) | I-12 | $2.5 \times 10^{-3}$ | — | — | 100 | 4.0 | 1 |
| 2 | " | AgBrCl (Br = 70 mol %) | " | " | A-1 | $1.5 \times 10^{-3}$ | 150 | 12 | 4 |
| 3 | " | AgBrCl (Br = 70 mol %) | " | " | A-7 | " | 140 | 11 | 4 |
| 4 | " | AgBrCl (Br = 70 mol %) | " | " | A-13 | " | 130 | 10 | 3 |
| 5 | B | AgBrCl (Br = 30 mol %) | " | " | — | — | 100 | 4.5 | 1 |
| 6 | " | AgBrCl (Br = 30 mol %) | " | " | A-1 | $7.6 \times 10^{-4}$ | 160 | 15 | 5 |
| 7 | " | AgBrCl (Br = 30 mol %) | " | " | A-7 | " | 160 | 13 | 4 |
| 8 | " | AgBrCl (Br = 30 mol %) | " | " | A-13 | " | 140 | 12 | 4 |

It is apparent from the results of Table 1 above that a combined use of the hydrazine derivative and the compound of the formula (A) according to the present invention makes it possible to provide a hard gradation having a gamma of 10 or more and very excellent dot quality through rapid access processing. It can also be seen that such a combined use produces a great effect to increase sensitivity.

EXAMPLE 2

Monodispersed Negative Silver Chlorobromide Emulsion C (bromine content: 30 mol%, mean grain size: 0.20 μm) containing $5.0 \times 10^{-5}$ mol of rhodium per mol of silver was prepared in the presence of rhodium ammonium chloride.

The emulsion was washed with water to remove soluble salts in a known manner, and 4-hydroxy-6-methyl-1,3,3a,7-tetraazaindene was added thereto as a stabilizer.

Emulsion C was divided into four portions (Sample Nos. 9 to 12). To each of the samples was added $2.5 \times 10^{-3}$ mol of Hydrazine Derivative I-20 per mol of silver, and to each of Sample Nos. 10 to 12 was added $7.6 \times 10^{-4}$ mol of the compound of the formula (A) per mol of silver as shown in Table 2. A polyethyl acrylate dispersion and sodium 2-hydroxy-4,6-dichloro-1,3,5-triazine was then added to each of the samples, and the resulting composition was coated on a polyethylene terephthalate film to a silver coverage of 3.5 g/m$^2$.

Each of the exposed samples was wedgewise exposed to light for sensitometry using a printer, "P-607" manufactured by Dainippon Screen Mfg. Co., Ltd., and then subjected to development with the same developer as used in Example 1 at 38° C. for 20 seconds, stopping, fixing, washing and drying.

Photographic properties of the thus developed films were evaluated, and the results obtained are shown in Table 2.

In Table 2, "relative sensitivity" was obtained in the same manner as in Example 1 and expressed taking the sensitivity of Sample 9 which contained no compound of the formula (A) as 100 (standard).

"Gamma" was obtained in the same manner as in Example 1.

"A letter image quality" was evaluated by the method described in Japanese Patent Application (OPI) No. 190943/83 (U.S. Pat. No. 4,452,882) as follows. A base, a film having formed thereon a positive line image (line image original), a base and a film having formed thereon a dot image (dot image original) were superposed in this order, and the laminate was brought into intimate contact with the film sample in such a manner that a protective layer of the film sample and the dot original of the above laminate faced to each other. The sample was then exposed to light of such an exposure that a 50% dot area might become 50% dot area on the film sample. After the film sample was processed as described above, a sample which could reproduce a letter of 30 μm in width of the line original was graded 5, and a sample which could reproduce a letter of 150 μm or more in width was graded 1. Grades 4, 3 and 2 were provided therebetween by organoleptic evaluation. Grade 2 is the lowest limit for practical use.

TABLE 2

| Sample No. | Emulsion Type | Emulsion Amount of Rh Contained (mol/mol Ag) | Hydrazine Derivative Type | Hydrazine Derivative Amount (mol/mol Ag) | Compound (A) Type | Compound (A) Amount (mol/mol Ag) | Relative Sensitivity | Gamma | Image Quality |
|---|---|---|---|---|---|---|---|---|---|
| 9 | C | $5 \times 10^{-5}$ | I-20 | $2.5 \times 10^{-3}$ | — | — | 100 | 8 | 2 |
| 10 | " | " | " | " | A-1 | $7.6 \quad 10^{-4}$ | 130 | 28 | 5 |
| 11 | " | " | " | " | A-7 | " | 130 | 25 | 5 |
| 12 | " | " | " | " | A-13 | " | 120 | 20 | 4 |

It can be seen from Table 2 that the combined use of the hydrazine derivative and the compound of the formula (A) in emulsions containing a large quantity of rhodium produces a remarkable effect to increase contrast and the letter image quality of such emulsions is very excellent.

EXAMPLE 3

Light-sensitive material samples were prepared in the same manner as described in Example 2 except Hydrazine Derivative I-22, compound A-1 (the compound of the formula (A)) and the compound of the formula (II) as shown in Table 3 below were used. The resulting samples were exposed and developed in the same manner as in Example 2. The results obtained are shown in Table 3 below.

TABLE 3

| Sample No. | Emulsion Type | Emulsion Amount of Rh Contained (mol/mol Ag) | Hydrazine Derivative Kind | Hydrazine Derivative Amount (mol/mol Ag) | Compound (A) Kind | Compound (A) Amount (mol/mol Ag) | Compound (II) Kind | Compound (II) Amount (mol/mol Ag) | Relative Sensitivity | Gamma |
|---|---|---|---|---|---|---|---|---|---|---|
| 13 | D | $5 \times 10^{-5}$ | I-22 | $3 \times 10^{-3}$ | — | — | — | — | 100 | 9 |
| 14 | " | " | " | " | A-1 | $7.6 \times 10^{-4}$ | — | — | 150 | 25 |
| 15 | " | " | " | " | " | " | II-1 | $1 \times 10^{-3}$ | 190 | 35 |
| 16 | " | " | " | " | " | " | II-2 | " | 180 | 30 |

Note:
"Relative sensitivity" and "gamma" were obtained in the same manner as in Example 1.

It can be seen from the results of Sample Nos. 15 and 16 in Table 3 that use of the phosphonium salt compound of the formula (II) in combination with the hydrazine derivative and the compound of the formula (A) further enhances the effect to increased contrast.

While the invention has been described in detail and with reference to specific embodiments thereof, it will be apparent to one skilled in the art that various changes and modifications can be made therein without departing from the spirit and scope thereof.

What is claimed is:

1. A negative silver halide photographic light-sensitive material comprising a support having provided thereon at least one silver halide emulsion layer, wherein at least one of the silver halide emulsion layer or another hydrophilic colloidal layer contains a hydrazine derivative and a compound represented by the formula (A):

$$R_1—S—S—R_2 \qquad (A)$$

wherein $R_1$ and $R_2$, which may be the same or different, each represents an aliphatic hydrocarbon group, an aromatic hydrocarbon group or a heterocyclic group provided that when $R_1$ or $R_2$ represent a heterocyclic group the heterocyclic ring thereof is directly bonded to one of the sulfur atoms in the disulfide linkage represented by —S—S— in formula (A), or when $R_1$ and $R_2$ are both aliphatic hydrocarbon group they may together form a ring, and said emulsion is capable of providing a high contrast image having a gamma of 10 or more with a stable developer.

2. A negative silver halide photographic light-sensitive material as in claim 1, wherein $R_1$ and $R_2$, which may be the same or different, each represents an aliphatic hydrocarbon group.

3. A negative silver halide photographic light-sensitive material as in claim 2, wherein $R_1$ and $R_2$ together form a ring.

4. A negative silver halide photographic light-sensitive material as in claim 3, wherein $R_1$ and $R_2$ form the following ring

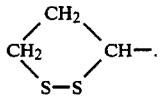

5. A negative silver halide photographic light-sensitive material as in claim 1, wherein the compound of the formula (A) is present in an amount of from $1 \times 10^{-7}$ mol to $1 \times 10^{-2}$ mol per mol of silver halide.

6. A negative silver halide photographic light-sensitive material as in claim 5, wherein the compound of the formula (A) is present in an amount of from $1 \times 10^{-6}$ to $5 \times 10^{-3}$ mol per mol of silver halide.

7. A negative silver halide photographic light-sensitive material as in claim 1, wherein the hydrazine derivative is an arylhydrazide wherein a sulfinic acid residue is bonded to the hydrazo moiety thereof or a compound represented by the formula (I):

$$R_3—NHNH—G—R_4 \qquad (I)$$

wherein $R_3$ represents an aliphatic group or an aromatic group; $R_4$ represents a hydrogen atom, a substituted or unsubstituted alkyl group, a substituted or unsubstituted aryl group, a substituted or unsubstituted alkoxy group or a substituted or unsubstituted aryloxy group; and G represents a carbonyl group, a sulfonyl group, a sulfoxy group, a phosphoryl group or an N-substituted or unsubstituted iminomethylene group.

8. A negative silver halide photographic light-sensitive material as in claim 7, wherein $R_3$ represents an aryl group.

9. A negative silver halide photographic light-sensitive material as in claim 7, wherein G is a carbonyl group.

10. A negative silver halide photographic light-sensitive material as in claim 9, wherein $R_4$ is a hydrogen atom, a methyl group, a methoxy group, an ethoxy group or a substituted or unsubstituted phenyl group.

11. A negative silver halide photographic light-sensitive material as in claim 10, wherein $R_4$ is a hydrogen atom.

12. A negative silver halide photographic light-sensitive material as in claim 1, wherein the hydrazine derivative is present in an amount of from $1 \times 10^{-6}$ to $5 \times 10^{-2}$ mol per mol of silver halide.

13. A negative silver halide photographic light-sensitive material as in claim 12, wherein the hydrazine derivative is present in an amount of from $1 \times 10^{-5}$ to $2 \times 10^{-2}$ mol per mol of silver halide.

14. A negative silver halide photographic light-sensitive material as in claim 1, wherein at least one of the silver halide emulsion layers and another hydrophilic colloidal layer further contains a compound represented by the formula (II):

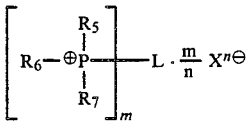

(II)

wherein $R_5$, $R_6$ and $R_7$ each represents a substituted or unsubstituted alkyl group, a substituted or unsubstituted cycloalkyl group, a substituted or unsubstituted aryl group, a substituted or unsubstituted alkenyl group, a substituted or unsubstituted cycloalkenyl group or a substituted or unsubstituted heterocyclic group; m represents an integer; L represents an m-valent organic group which is bonded to the P atom via a carbon atom of L; n represents an integer of from 1 to 3; and X represents an n-valent anion which may be connected to L.

15. A negative silver halide photographic light-sensitive material as in claim 14, wherein m represents an integer of 1 or 2; L represents a group having not more than 20 carbon atoms selected from the groups as recited for $R_5$, $R_6$ and $R_7$ or a divalent organic group having not more than 20 carbon atoms; n represents an integer of 1 or 2; and X represents a monovalent or divalent anion which may be connected to L.

16. A negative silver halide photographic light-sensitive material as in claim 14, wherein the compound of the formula (II) is present in an amount of from $1\times10^{-6}$ to $1\times10^{-1}$ mol per mol of silver halide.

17. A negative silver halide photographic light-sensitive material as in claim 16, wherein the compound of the formula (II) is present in an amount of from $1\times10^{-5}$ to $5\times10^{-2}$ mol per mol of silver halide.

18. A method for forming an image on a negative silver halide photographic light-sensitive material comprising a support having provided thereon at least one silver halide emulsion layer, wherein at least one silver halide emulsion layer or another hydrophilic colloidal layer contains a hydrazine derivative and a compound represented by the formula (A):

$$R_1—S—S—R_2 \qquad (A)$$

wherein $R_1$ and $R_2$, which may be the same or different, each represents an aliphatic hydrocarbon group, an aromatic hydrocarbon group or a heterocyclic group, provided that when $R_1$ or $R_2$ represent a heterocyclic group the heterocyclic ring thereof is directly bonded to one of the sulfur atoms in the disulfide linkage represented by —S—S— in formula (A), or when $R_1$ and $R_2$ are both aliphatic hydrocarbon group they may together form a ring, which comprises imagewise exposing and then developing with a developer containing 0.15 mol/l of a sulfite ion and having 9.5 or larger of pH value to provide a high contrast image having a gamma of 10 or more.

19. A method for forming an image on a negative silver halide photographic light-sensitive material as in claim 18, wherein the compound of the formula (A) is present in an amount of from $1\times10^{-7}$ mol to $1\times10^{-2}$ mol per mol of silver halide.

20. A negative silver-halide photographic light-sensitive material as claimed in claim 1, wherein $R_1$ and $R_2$, which may be the same or different, each represents an aliphatic hydrocarbon group or an aromatic hydrocarbon group.

21. A method for forming an image as in claim 18 wherein $R_1$ and $R_2$, which may be the same or different, each represents an aliphatic hydrocarbon group or an aromatic hydrocarbon group.

* * * * *